US009194577B2

(12) United States Patent
Brodeβer et al.

(10) Patent No.: US 9,194,577 B2
(45) Date of Patent: Nov. 24, 2015

(54) METHOD FOR OPERATING A ONCE-THROUGH STEAM GENERATOR AND STEAM GENERATOR DESIGNED FOR CARRYING OUT THE METHOD

(75) Inventors: Joachim Brodeβer, Nürnberg (DE); Martin Effert, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/007,723

(22) PCT Filed: Mar. 9, 2012

(86) PCT No.: PCT/EP2012/054105

§ 371 (c)(1), (2), (4) Date: Sep. 26, 2013

(87) PCT Pub. No.: WO2012/130588

PCT Pub. Date: Oct. 4, 2012

(65) Prior Publication Data

US 2014/0014189 A1 Jan. 16, 2014

(30) Foreign Application Priority Data

Mar. 30, 2011 (DE) ..... 10 2011 006 390

(51) Int. Cl.
*F22D 5/00* (2006.01)
*F22B 29/12* (2006.01)
*F22B 35/10* (2006.01)

(52) U.S. Cl.
CPC ..... *F22B 29/12* (2013.01); *F22B 35/101* (2013.01); *Y10T 137/0374* (2015.04)

(58) Field of Classification Search
CPC ..... B01D 19/0042; B01F 5/106; F22B 29/06; F22B 37/26; F22B 35/10; F22B 35/102; F22D 11/006
See application file for complete search history.

(56) References Cited

U.S. PATENT DOCUMENTS 3,412,714 A * 11/1968 Rupprecht ..... 122/406.1
4,205,633 A 6/1980 Wittchow (Continued)

FOREIGN PATENT DOCUMENTS

DE 1401348 A1 10/1969
DE 3243578 A1 5/1984

(Continued)

OTHER PUBLICATIONS

Fan, Quan-Gui et al; "Technological Analysis of 600 MW Supercritical Boiler Start up System"; North China Electric Power University; vol. 37; pp. 16-19; 2006; CN.

(Continued)

*Primary Examiner* — Gregory A Wilson

(57) ABSTRACT

A method for operating a once-through steam generator including an evaporator, in which a feeding mass flow of a flow medium is supplied using a feed pump to the evaporator and at least partially evaporated there, wherein flow medium that has not evaporated is separated in a separator arranged downstream of the evaporator and a circulating mass flow of the separated flow medium is returned using a circulating pump to the evaporator, and the mass flow referred to as the evaporator mass flow of the flow medium flowing through the evaporator is additively composed of the feeding mass flow and the circulating mass flow. In a low-load interval, the feeding mass flow is increased with increasing load while the circulating mass flow is kept substantially constant, in a moderate load interval the feeding mass flow is further increased with increasing load and the circulating mass flow is reduced to zero.

13 Claims, 2 Drawing Sheets

(56) References Cited

U.S. PATENT DOCUMENTS

| | | | | |
|---|---|---|---|---|
| 4,367,628 | A | 1/1983 | Mangus | |
| 5,575,244 | A * | 11/1996 | Dethier | 122/406.1 |
| 8,297,236 | B2 * | 10/2012 | Franke et al. | 122/1 B |
| 2007/0283906 | A1 * | 12/2007 | Albrecht | 122/406.1 |
| 2011/0023487 | A1 * | 2/2011 | Olia | 60/653 |
| 2011/0139094 | A1 * | 6/2011 | Bruckner et al. | 122/451.1 |
| 2014/0123914 | A1 * | 5/2014 | Stark et al. | 122/1 B |

FOREIGN PATENT DOCUMENTS

| | | | |
|---|---|---|---|
| DE | 4236835 | A1 | 5/1994 |
| EP | 0544615 | A1 | 6/1993 |
| FR | 1349790 | A | 1/1964 |
| JP | S4124881 | B | 7/1962 |
| JP | S3918456 | B | 12/1966 |
| JP | S624604 | B | 1/1987 |
| JP | S62106804 | A | 5/1987 |
| JP | S62237204 | A | 10/1987 |
| JP | 7506662 | A1 | 7/1995 |
| JP | 20005967097 | A | 3/2000 |
| JP | 2002106804 | A | 4/2002 |
| JP | 2006322690 | A | 11/2006 |
| NL | 6910208 | A | 1/1971 |
| WO | WO 9323702 | A1 | 11/1993 |
| WO | WO 9410501 | A1 | 11/1994 |

OTHER PUBLICATIONS

Jia, Liang-Jun et al; "Problems and Discussing in t he Design and Manufacture of Large Nozzles of St art up Separator"; Shangehi Boiler Works Lid; 2002; CN.

* cited by examiner

METHOD FOR OPERATING A ONCE-THROUGH STEAM GENERATOR AND STEAM GENERATOR DESIGNED FOR CARRYING OUT THE METHOD

CROSS REFERENCE TO RELATED APPLICATIONS

This application is the U.S. National Stage of International Application No. PCT/EP2012/054105 filed Mar. 30, 2011 and claims benefit thereof, the entire content of which is hereby incorporated herein by reference. The International Application claims priority to the German application No. 10 2011 006390.0 DE filed Mar. 30, 2011, the entire contents of which is hereby incorporated herein by reference.

FIELD OF INVENTION

The invention relates to a method for operating a once-through steam generator comprising an evaporator in which a feeding mass flow is supplied with the aid of a feed pump to the evaporator and at least partially evaporated there, wherein flow medium that has not evaporated is separated in a separator arranged downstream of the evaporator and a circulating mass flow of the separated flow medium is returned with the aid of a circulating pump to the evaporator, so that the mass flow referred to as the evaporator mass flow of the flow medium flowing through the evaporator is additively made up of the feeding mass flow and the circulating mass flow. The invention further relates to a steam generator designed for carrying out the method.

BACKGROUND OF INVENTION

In a once-through steam generator the passage of the flow medium usually injected in the form of feed water is forced through the preheater, the evaporator and the superheater by an appropriately powerful feed water pump or feed pump. Thus the heating up of the flow medium to saturated steam temperature, the evaporation and the subsequent superheating occur continuously in one pass, so that no drum is needed. By contrast with a steam generator which is designed for operation with natural circulation, a once-through steam generator can also be operated in the supercritical range at pressures of 230 bar and more. With once-through vessels very high steam pressures can be generated in a relatively small space. Since the quantity of flow medium in the system is relatively small the system has a low inertia and allows a rapid reaction to rapid reaction to load changes.

Fired once-through steam generators with evaporator tubes wound in the form of a spiral around a combustion chamber (so called spiral tubing) are usually designed for a mass flow density of the flow medium carried through the evaporator tubes of appr. 2000 kg/(sm$^2$) at 100% load (full load). In accordance with the previous usual design guidelines the mass flow density in an evaporator with smooth tubes should not fall below a value of around 800 kg/(sm$^2$) at part load, in order to avoid cooling problems on the tube walls through a layering of the flow. This value corresponds, for the above-mentioned full load mass flow densities of 2000 kg/(sm$^2$) to a load value of 40% of the full load. This is then also the load case for which the minimum evaporator mass flow is defined. In startup and low-load operation it is ensured through the feed water regulation that this minimum evaporator mass flow is always fed to the evaporator.

Non-evaporated water, which occurs precisely in startup and low-load operation, is usually separated from steam in a water separator (or separator) connected downstream of the evaporator and carried to a water collection vessel (the so-called collection flask or flask), while the steam is generally fed to a superheater. Often a circulating pump is used to recirculate the separated water and bind it into the feeding water mass flow (or feeding mass flow) before the feed water preheater, also referred to as the economizer, i.e. ultimately carry it back to the evaporator inlet. The evaporator mass flow in this case is made up additively of the feeding mass flow and the circulating mass flow, also referred to as the recirculating mass flow. Such arrangements are known for example from DE 32 43 578 A1, DE 42 36 835 A1 or U.S. Pat. No. 3,412,714.

In a previously usual mode of operation the feeding mass flow is constantly increased on startup, while the circulating mass flow is reduced to the same degree. Consequently, in the above-mentioned example, the circulating pump must be designed for a comparatively high circulating mass flow density of appr. 800 kg/(ms$^2$) corresponding to 40% of the full-load value of the evaporator mass flow density, since in no-load operation or slightly above this level almost the entire evaporator mass flow is formed by the circulating mass flow. This comparatively high design mass flow of the circulating pump leads to the circulating pump having to be dimensioned comparatively powerful and large and accordingly being associated with high procurement costs.

SUMMARY OF INVENTION

The underlying object of the invention is thus to specify a method for operating a once-through steam generator of the aforementioned type which avoids the said disadvantages, is thus designed with procurement and operating costs kept low for effective and safe part-load operation with sufficient cooling of the evaporator tubes. Furthermore a once-through steam generator especially suitable for carrying out the method is to be specified.

In relation to the method the desired object is achieved in that

- in a low-load interval the feeding mass flow is increased as the load increases, while the circulating mass flow is substantially kept constant,
- in a moderate-load interval the feeding mass flow is further increased as the load increases and the circulating mass flow is reduced to zero, and
- if necessary in a high-load interval the feeding mass flow is increased as the load increases further and the circulating mass flow is held at zero.

Operation in the high-load interval is referred to as once-through operation since water no longer arises in the separator.

The reference to the case of increasing load is only made here for the purposes of a unique definition; the regulation characteristic applies equally to the case of a decreasing load. This means for example that in the low-load interval the feeding mass flow is reduced as the load decreases, etc.

The invention is based on the idea that, although it would be possible in principle to dispense with the recirculation circuit with the circulating pump, thus to simply take away the water separated in the separator during startup and in low-load operation and discard it (so-called gravity operation). However this would be disadvantageous from the standpoints of thermodynamics and economy and in addition—because of the low fluid temperatures at the inlet of economizer and evaporator and thus the lower production of steam acting to cool the heating surfaces—would lead to an undesired increase in the thermal load on the superheater surfaces downstream from the evaporator during startup operation.

The present invention departs from the design guidelines for circulating mass flow previously applicable and regarded as proven in operation. It has in fact namely surprisingly been found that the design mass flow for the circulating pump, at least in a low-load interval, can be greatly reduced compared to the previous level of knowledge, without having to accept any disadvantages. In particular in the vicinity of the no-load state, the minimum evaporator mass flow—in this case effected almost exclusively by the circulating mass flow—can be halved compared to the previously defined value. In this case ensuring a sufficient cooling of the evaporator tubes under these conditions—even if they are designed as smooth tube—can be verified by corresponding thermohydraulic calculations and simulations. Towards higher load ranges the previously widely-used values for the minimum evaporator mass flow would then be specified again and achieved by the corresponding regulation of the feeding mass flow and the circulating mass flow. The transition between the two regulation scenarios is preferably continuous, especially linear.

Advantageously in the low-load interval the feeding mass flow is increased linearly as the load increases. When the circulating mass flow is kept constant this means that the entire evaporator mass flow—as already mentioned the sum of feeding mass flow and circulating mass flow—increases linearly with the load.

Preferably the feeding mass flow is also increased linearly with an increasing load in the moderate-load interval, while the circulating mass flow is preferably reduced linearly with an increasing load. In an especially preferred embodiment in this case the circulating mass flow is reduced by the same amount as the mass flow is increased. This means that the sum of the two mass flows, namely the evaporator mass flow, remains constant in the moderate-load interval.

Expediently the low-load interval begins at no load and preferably ends at approximately 20% of the full load provided for by the design. The low-load interval is expediently followed directly by the moderate-load interval, which preferably ends at around 40% of the full load provided for by the design.

In an especially preferred design the circulating mass flow in the low-load interval is set at approximately 20% of the full load value of the evaporator mass flow. In this case, in the low-load interval, a value of the circulating mass flow density of approximately 400 kg/(sm$^2$) is especially advantageous, corresponding to an evaporator mass flow density at full load of some 2000 kg/(sm$^2$).

In a further advantageous embodiment the circulating mass flow and the fees mass flow in the medium-load interval are set such that the evaporator mass flow in this interval always reaches at least 40% of the full load value. Especially preferred here is the case in which the evaporator mass flow in this load interval is kept constant by opposingly changing the feeding flow and circulating flow (see above).

In relation to the once-through steam generator the object stated at the outset is achieved by a once-through steam generator with an evaporator which is connected on the flow medium side upstream of a feed pump and downstream of a separator for non-evaporated flow medium, whereby the separator is connected via a return line, into which a circulating pump is connected, to the water-side steam generator inlet, and wherein an electronic control or regulation unit is provided for the feed pump and the circulating pump, which carries out the method steps of the method described above.

As already indicated at the start, the return line expediently opens out upstream of the feed pump and downstream of the feed water preheater into the feed line. The separator is thus connected (directly) above the feed water preheater to the evaporator inlet.

A corresponding control or regulation program is advantageously implemented by hardware and/or software in the control or regulation unit for the said purpose. Via suitable adjustment value generators the control or regulation unit acts in accordance with previous operating inputs (such as: Startup, shut down, part-load mode, etc.) on the feed pump and the circulating pump and controls their delivery power, that is to say the respective throughput of flow medium (feed water and separated water from the evaporator). Via suitable measured value generators or sensors the control or regulation unit is expediently supplied with the actual value of relevant operating variables, so that a corresponding adjustment can be made if said variables deviate from a desired setpoint value.

The once-through steam generator is preferably fired directly by a number of burners. Preferably it has a combustion chamber or a gas duct, the surrounding wall of which is formed by a plurality of evaporator tubes welded in a gas-tight manner to one another, wherein at least a part area of the surrounding wall forms the actual evaporator (as well as further areas if necessary which form the feed water preheater or the superheater). The gas duct is preferably embodied as a vertical gas duct and has spiral tubing at least in the evaporator section, meaning evaporator tubes windings spirally or in a helix shape within the surrounding wall around the longitudinal axis of the gas duct. The evaporator tubes preferably involve smooth tubes; but tubes provided with an inner ribbing are also conceivable.

When tubes with inner ribbing are used in spiral evaporators the minimum mass flow density at the highest load in circulating mode can be reduced from the typical value for smooth tubes of 800 kg/(sm$^2$) to around 500 kg/(sm$^2$). Therefore an evaporator with inner-ribbed tubes can be driven at loads above 25% of the full load in once-through operation if the full load mass flow density of the evaporator lies at 2000 kg/(sm$^2$). Even if inner-ribbed tubes are used in a spiral evaporator, the circulating pump can have especially compact dimensions according to the invention. With a spiral evaporator with inner-ribbed tubes the transition from circulating into once-through mode lies at around 25% load instead of at 40% load. The previous and following descriptions which are designed numerically for an evaporator with smooth tubes can also be transferred, taking into account this peripheral condition, to an evaporator with inner-ribbed tubes.

The advantages achieved with the invention are especially that, by intentionally departing from previously mandatory design principles, an operation of a once-through steam generator with return of the liquid flow medium (water) separated at or after the evaporator is made possible into the feed water preheater (so-called once-through mixed system) in which, despite a comparatively low selected circulating mass flow in the vicinity of the no-load range, a high operational safety and sufficient tube cooling is guaranteed. The circulating pump can in this case have especially compact dimensions and accordingly be able to be procured at low cost.

BRIEF DESCRIPTION OF THE DRAWINGS

An exemplary embodiment of the invention is explained in greater detail below with reference to drawings. These show the following greatly simplified and schematicized figures.

DETAILED DESCRIPTION OF INVENTION

Figure 1:
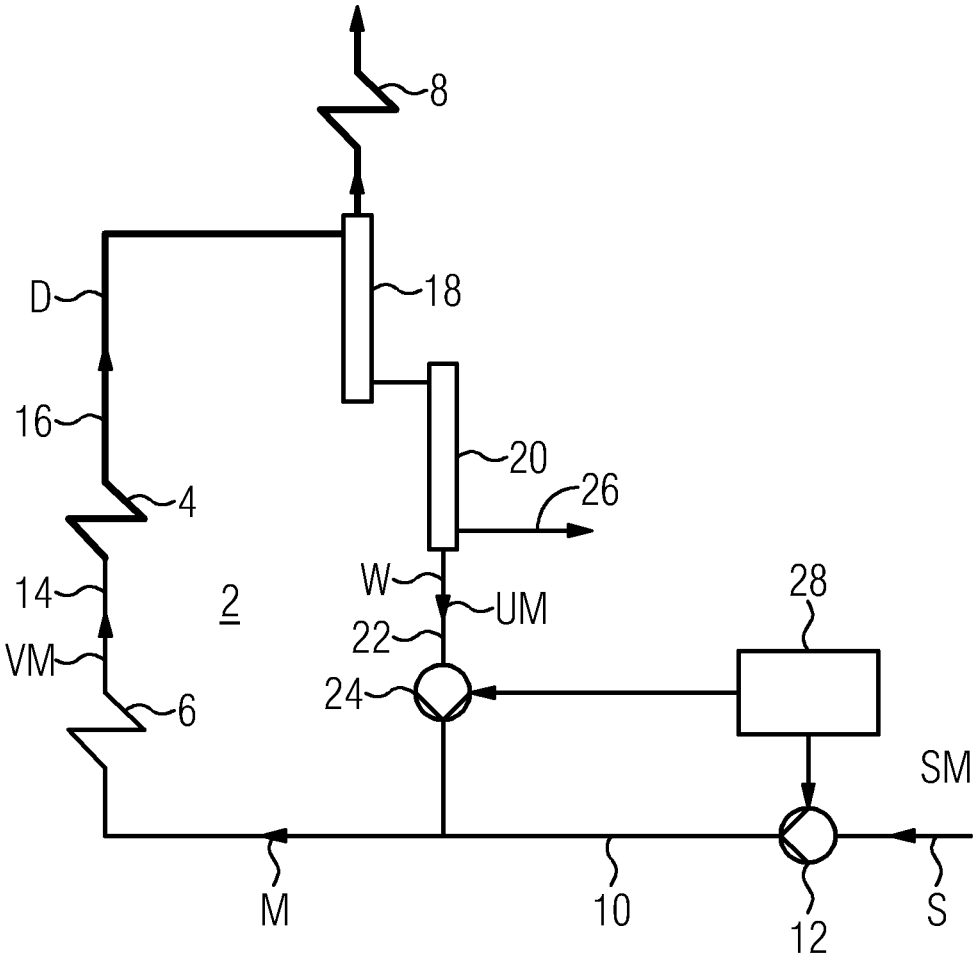
FIG. 1 shows a block diagram of a once-through steam generator.

The once-through steam generator 2 shown in FIG. 1 comprises an evaporator 4 for evaporating a flow medium M which is connected upstream on the flow medium side of a feed water preheater 6, also referred to as an economizer. The evaporator 4 comprises a plurality of steam generator tubes connected in parallel as regards flow, welded gas-tight to one another and designed as smooth tubes which, as a type of spiral tubing, form an area of an enclosing wall of a combustion chamber, which is heated via a number of burners (not shown in detail here). A superheater 8 with a number of superheater heating surfaces is connected downstream of the evaporator 4 on the flow medium side. During operation of the once-through steam generator 2 the flow medium M in the form of feed water S is fed to the feed water preheater 6 by the feed line 10 with the aid of a feed pump 12, is preheated in the feed water preheater 6, subsequently conveyed via the evaporator inlet 14 into the evaporator 4 and evaporated there. The steam D leaving the evaporator 4 via the evaporator outlet 16 is finally superheated in the superheater 8 and then supplied for its intended use, for example in a steam turbine.

In part load operation, especially when the once-through steam generator 2 is being started up or shut down, the flow medium M is not completely evaporated in the evaporator 4 but a portion of unevaporated fluid flow medium M, namely water W remains at the evaporator outlet 16. This water portion is separated and removed from the steam portion which is forwarded to the superheater 8 in a separator 18 connected on the flow medium side between the evaporator 4 and the superheater 8. The separated water W is collected in a collection vessel 20 connected to the separator 18 and returned from there, depending on the operating state in different amounts via a return line 22 to the inlet of the feed water preheater 6. For this purpose a circulating pump 24 is connected into the return line 22, and the return line 22 is connected downstream of the feed pump 12 and upstream of the feed water preheater 6 to the feed line 10. Surplus water W is drained out of the collection vessel 20 via a drain line 26.

The mass flow of flow medium M flowing through the evaporator 4, namely the evaporator mass flow VM is thus composed additively of the mass flow of supplied feed water S, namely the feeding mass flow SM and the mass flow of previously separated water W, namely the circulating mass flow UM circulated back with the aid of the circulating pump 24. Instead of the term mass flow the term throughflow is also used in everyday parlance.

An electronic control or regulation unit 28 acting on the feed pump 12 and the circulating pump 24 and also if necessary on setting or regulating valves in the line system of the flow medium M not shown here is used for operating-state-dependent control or regulation of this mass flow, specifically during start-up or low-load operation. To detect the operational actual state a number of sensors connected to the control or regulation unit 28 are also provided (not shown here).

Figure 2:
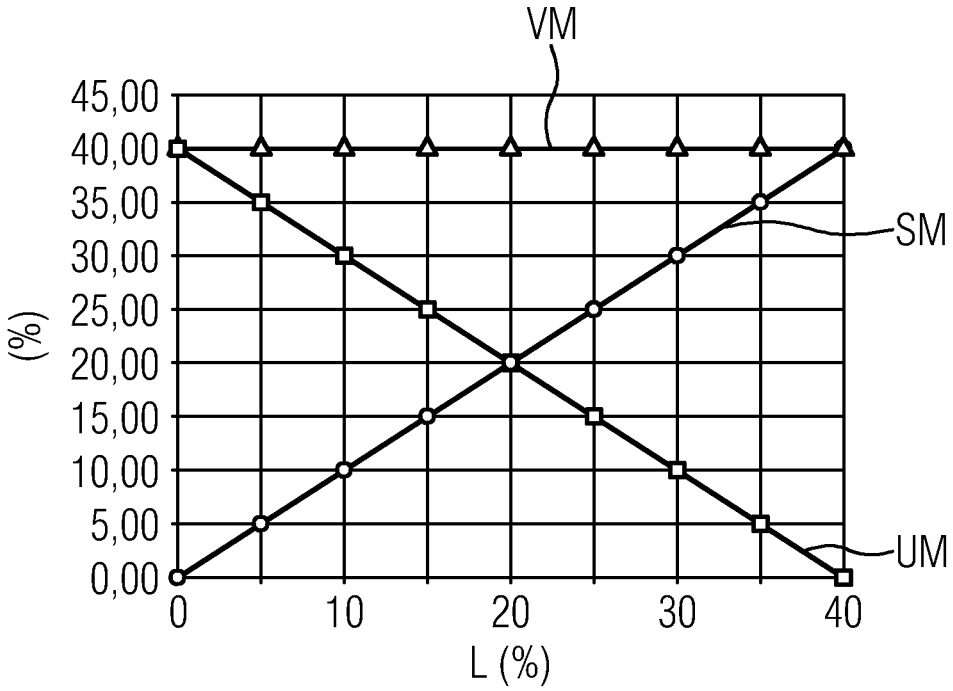
FIG. 2 shows a diagram in which various data lines characteristic for the passage of flow medium through corresponding components of the once-through steam generator and for its previous operational control are plotted as a function of the load.

FIG. 2 shows the graph of relevant characteristic data lines for this in accordance with a conventional regulation scheme. The circulating mass flow UM, the feeding mass flow SM and the evaporator mass flow VM are plotted here as a function of the load L. The load values on the abscissa are each specified as a percentage value of the maximum load (full load), and in a similar manner the throughflow or mass flow values on the ordinate are specified as percentage values of the maximum evaporator mass flow VM at full load provided for by the design. As can be seen, the circulating mass flow UM decreases as the load increases from the initial value of 40% (corresponding to 0% load) constantly and especially linearly to the value 0% (corresponding to 40% load) while the value of the feeding mass flow SM increases linearly from 0% to 40% in the corresponding load interval. The sum of the feeding mass flow SM and the circulating mass flow UM which represents the evaporator mass flow VM therefore possesses the constant value 40% in this load interval. With even greater loads the circulating mass flow UM remains at the value 0% while the feeding mass flow SM and thus the evaporator mass flow VM increase to the full load value 100% (no longer shown in the diagram). The circulating pump 24 must therefore be designed for a comparatively high mass flow value of 40% of the evaporator mass flow VM at full load.

Figure 3:
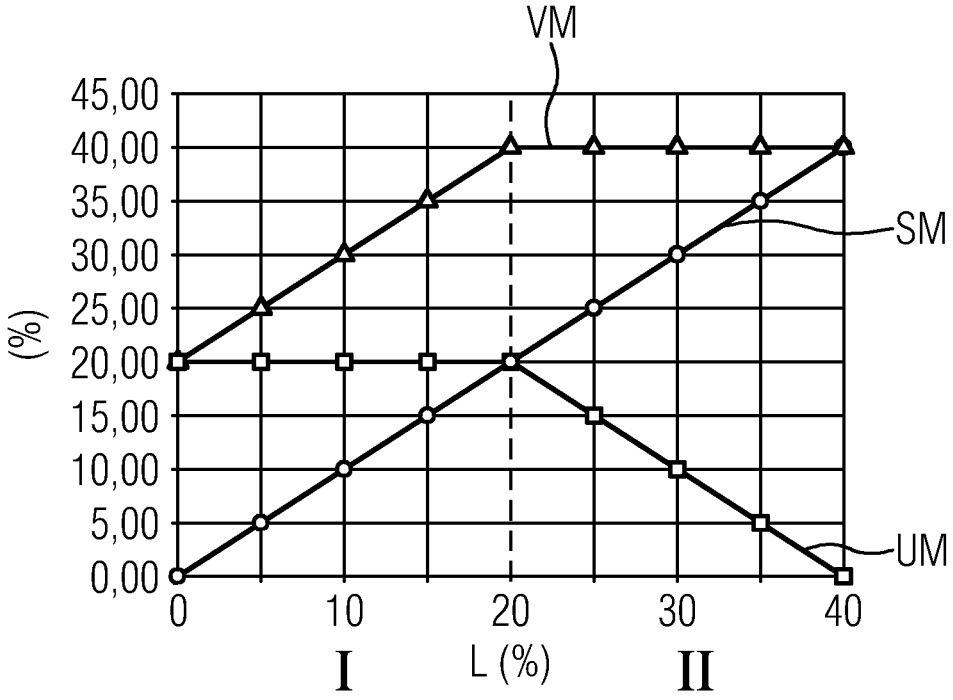
FIG. 3 shows a further such diagram, wherein the course of the data lines corresponds to an innovative, inventively-improved operational control.

By comparison FIG. 3 shows an improved regulation scheme in respect of the demands on the circulating pump 24 in a diagrammatic presentation similar to that of FIG. 2. Similarly to the regulation variants represented by FIG. 2, the feeding mass flow SM is increased linearly in the load interval between 0% and 40% load from the value 0% to the value 40%. Unlike the previous variants the circulating mass flow UM is now kept constant in a first load interval between 0% and 20% load, referred to here as the low-load interval I, at a reduced value of 20% compared to FIG. 2. Only in the subsequent moderate-load interval II between 20% load and 40% load is the circulating mass flow reduced linearly to the value 0%. Consequently the evaporator throughflow in the low-load interval I rises from the value 20% linearly to the value 40% and is held in the moderate-load interval II at the value 40%. In the subsequent high-load interval shown on the right on the other side of 40% load (no longer shown) the mass flow SM and thus the evaporator mass flow VM rises as in the case previously discussed, up to the full-load value of 100%.

By the reduction of the design mass flow for the circulating pump 24 to a value of 20% of the maximum evaporator mass flow VM, halved by comparison with FIG. 2, the requirements on the circulating pump 24 are greatly reduced without endangering adequate cooling of the evaporator tubes of the evaporator 4 in the low-load range.

The invention claimed is:

1. A method for operating a once-through steam generator with an evaporator, comprising:

feeding a feeding mass flow of a flow medium using a feed pump to the evaporator and at least partly evaporated there in the evaporator, separating evaporated flow medium from non-evaporated flow medium in a separator, the separator connected downstream from the evaporator, the non-evaporated flow medium feeds into to a circulating mass flow of the non-evaporated flow medium using a circulating pump into the evaporator, so that the mass flow referred to as the evaporator mass flow of the flow medium flowing through the evaporator is composed additively of the feeding mass flow and the circulating mass flow, wherein in a low-load interval the feeding mass flow is increased as a load rises, while the circulating mass flow is kept substantially constant, wherein in a moderate-load interval the feeding mass flow is increased further with increasing load and the circulating mass flow is reduced to zero, and wherein, for the moderate-load interval a minimum value is defined for the evaporator mass flow and, for the low-load interval, the circulating mass flow is substantially kept constant at the halved minimum value.

2. The method as claimed in claim 1, wherein in the low-load interval the feeding mass flow is increased linearly with increasing load.

3. The method as claimed in claim 1, wherein in the moderate-load interval the feeding mass flow is increased linearly with increasing load.

4. The method as claimed in claim 1, wherein in the moderate-load interval the circulating mass flow is reduced linearly with increasing load.

5. The method as claimed in claim 1, wherein in the moderate-load interval the feeding mass flow is increased linearly with increasing load and the circulating mass flow is reduced linearly to the same extent with increasing load.

6. The method as claimed in claim 1, wherein the low-load interval begins at no load.

7. The method as claimed in claim 6, wherein the low-load interval, when smooth tubes are used, ends at approximately 20%, and wherein the low load interval, when inner-ribbed tubes are used, ends at approximately 12.5% of the full load provided for by the design.

8. The method as claimed in claim 1, wherein the moderate-load interval follows directly on from the low-load interval.

9. The method as claimed in claim 8, wherein the moderate-load interval, when smooth tubes are used, ends at approximately 40%, and wherein when inner-ribbed tubes are used, the moderate-load interval ends at approximately 25% of the full load provided for by the design.

10. The method as claimed in claim 1, wherein the circulating mass flow in the low-load interval, when smooth tubes are used, is set at approximately 20%, and when inner-ribbed tubes are used the circulating mass flow is set at approximately 12.5% of the full load value of the evaporator mass flow.

11. The method as claimed in claim 1, wherein in the low-load interval, when smooth tubes are used, a circulating mass flow density of approximately 400 kg/(sm$^2$), and wherein in the low-load interval when inner-ribbed tubes are used a circulating mass flow density of approximately 250 kg/(sm$^2$) is set.

12. A once-through steam generator, comprising:

an evaporator for evaporating a flow medium, a feed pump connected upstream of the evaporator on the flow medium side a feed pump; and a separator connected downstream of the evaporator for non-evaporated flow medium, wherein the separator is connected via a feedback line, into each a circulating pump is connected, to the evaporator inlet, and wherein an electronic control regulation unit is provided for the feed pump and the circulating pump which carries out the method steps as claimed in claim 1.

13. A method for operating a once-through steam generator with an evaporator, comprising:

feeding a feeding mass flow of a flow medium using a feed pump to the evaporator and at least partly evaporated there in the evaporator;

separating evaporated flow medium from non-evaporated flow medium in a separator, the separator connected downstream from the evaporator, the non-evaporated flow medium feeds into to a circulating mass flow of the non-evaporated flow medium using a circulating pump into the evaporator, so that the mass flow referred to as the evaporator mass flow of the flow medium flowing through the evaporator is composed additively of the feeding mass flow and the circulating mass flow, wherein in a moderate-load interval the feeding mass flow is decreased with decreasing load and the circulating mass flow is increased, starting from zero, and wherein in a low-load interval the feeding mass flow is decreased further with decreasing load, while the circulating mass flow is kept substantially constant, and wherein, for the moderate-load interval a minimum value is defined for the evaporator mass flow and, for the low-load interval, the circulating mass flow is substantially kept constant at the halved minimum value.

* * * * *